US005427834A

United States Patent [19]

Sodetz

[11] Patent Number: 5,427,834

[45] Date of Patent: Jun. 27, 1995

[54] WATERPROOF TEXTILE

[75] Inventor: Robert O. Sodetz, Chicago, Ill.

[73] Assignee: IDM Enterprises, Homewood, Ill.

[21] Appl. No.: 35,473

[22] Filed: Mar. 23, 1993

Related U.S. Application Data

[63] Continuation-in-part of Ser. No. 785,454, Oct. 31, 1991, abandoned.

[51] Int. Cl.[6] ..... B32B 3/02

[52] U.S. Cl. ..... 428/83; 428/82; 428/88; 428/91; 428/95; 428/246; 428/265; 5/417; 5/420; 206/494

[58] Field of Search ..... 428/246, 260, 265, 82, 428/83, 88, 91, 95, 220; 81/83; 5/417, 420; 206/45.31, 494; 383/106

[56] References Cited

U.S. PATENT DOCUMENTS

| | | | |
|---|---|---|---|
| 4,278,719 | 7/1981 | Sarnecki | 428/78 |
| 4,316,287 | 2/1982 | Rule | 2/69.5 |
| 4,425,395 | 1/1984 | Negishi et al. | 428/196 |
| 5,056,172 | 10/1991 | Kaiser et al. | 5/417 |
| 5,084,930 | 2/1992 | Danova | 5/502 |

*Primary Examiner*—Christopher W. Raimund
*Attorney, Agent, or Firm*—Wallenstein & Wagner, Ltd.

[57] ABSTRACT

A textile product in the form of a light versatile blanket that is warm and waterproof is disclosed. The blanket comprises a waterproof nylon layer and a soft, smooth acrylic lining layer securably attached to the waterproof layer. The outer surface of the nylon layer is coated with urethane. The waterproof layer and the lining layer are attached by a binding element stitched along the perimeters of the two layers. The blanket may be packaged in a clear or semi-transparent vinyl case.

9 Claims, 1 Drawing Sheet

WATERPROOF TEXTILE

This is a continuation-in-part of Ser. No. 07/785,454 filed Oct. 31, 1991 now abandoned.

TECHNICAL FIELD

The present invention generally relates to a warm and waterproofed textile and, more particularly, to a waterproof blanket with a soft smooth lining.

BACKGROUND PRIOR ART

The textile industry produces a large variety of fabrics which are used to make an enormous assortment of products. Many of these products are designed for specific purposes while other products are capable of being used for multiple purposes.

The traditional raincoat, the fabric in an umbrella, and the tarp used to cover the infield of a baseball diamond during a rain delay are examples of textile products which have specific uses and functions and which are waterproof, either through an inherent property of the textile used or through the addition of a coating of a waterproof material to the textile. On the other hand, other textile products, such as a blanket, may have a variety of uses beyond their primary use.

For example, a blanket can be used to keep a person warm while resting or sleeping. In addition to its primary use, a blanket has several secondary uses. A blanket may be used to keep a person warm while attending an outdoor function, such as a baseball or football game, or it may be spread out in a park during a picnic or on the beach on a summer afternoon. Unfortunately, a conventional blanket becomes ineffective for almost any use when it is exposed to an undue amount of moisture. Thus, for example, one cannot rely on a conventional blanket during a rain shower at the local football game; similarly, use of a conventional blanket for a picnic the day after a storm can result in an unpleasant experience as the wet ground seeps through the fabric.

Accordingly, a need exists for a multipurpose waterproof textile product which is compact, light and easy to carry.

SUMMARY OF THE INVENTION

The textile product of the present invention can be embodied in the form of a blanket having a waterproof, or water resistant, layer and a lining layer securable attached to the waterproof layer. The waterproof layer may be formed from a nylon fabric coated with a waterproof material, or from a variety of waterproof fabrics or other fabrics coated with waterproof materials. The lining layer may be formed from a blend of polyester and cotton into a soft fleece, or from a variety of other soft materials or soft blends. In one embodiment, the lining layer may be formed from a 100% acrylic lining material having a relatively smooth soft feel to it. Each of these two layers may be dyed any color or have a design, pattern or image woven into or imprinted thereon. The blanket is substantially planar and may be shaped to have a generally rectangular or square surface area, although a variety of shapes are clearly possible. A blanket having a generally rectangular shape is constructed with a waterproof layer having a generally rectangular perimeter, or border, and a lining layer having a generally rectangular perimeter, or border, corresponding dimensionally to the perimeter or border of the waterproof layer.

The waterproof and lining layers may be securably attached in a number of ways. One way to securably attach the waterproof and lining layers is to place the layers together so that their perimeters are generally aligned, fold over a small portion of both layers together along each's perimeter, and form a hem along the folded perimeters.

Another preferred method of securably attaching the waterproof and lining layers may be achieved by use of a binding element. As in the first method described, the waterproof and lining layers are placed together so that their perimeters are generally aligned. Next, a binding element in the form of a thin strip of canvas or a heavy duty nylon material, is folded over the edge of each layer along each's perimeter so that the perimeters of both layers are sandwiched within the fold of the binding element. Finally, the folded binding element, waterproof layer and lining layer, are stitched together. The binding element will provide additional weight along the perimeter of the blanket which will prove beneficial for one of the possible uses of the blanket as described below.

The blanket of the present invention, like a conventional blanket, may be used to keep a person warm while attending an outdoor function, such as a baseball or football game. However, unlike a conventional blanket, the blanket of the present invention can be utilized during a rain or snow shower to keep the user dry and warm by wrapping the blanket around the user with the waterproof layer directed outwardly and the soft, smooth lining layer directed inwardly against the user's body. Also, like a conventional blanket, the blanket of the present invention may be spread out in a park for a picnic. Again however, unlike a conventional blanket, the blanket of the present invention may be utilized even if the ground is wet or muddy by spreading out the blanket with the waterproof side down. A blanket with a heavy binding along its perimeter is also particularly useful as a picnic blanket in that the heavy binding helps keep the blanket in place on the ground even on breezy days.

The blanket of the present invention also has many other beneficial properties and uses. For instance, the blanket disclosed herein can be used as a waterproof sleeping bag or a makeshift waterproof tent. Additionally, it can be folded and used as a waterproof seat cushion. The blanket of the present invention may be spread out and used as a beach blanket, and after such use it may be spread out over a car seat to protect the seat from wet bathing suits. Additional uses are only limited by the imagination of the user.

The blanket is preferably one component of a system which includes a carrying case as a second component. The carrying case may be made of a waterproof or water resistant material to keep the blanket dry. Additionally, the carrying case may be made from a transparent or semi-transparent vinyl material. In this manner, a folded blanket having a team logo or other graphics advantageously showing, may be displayed in the case in a store display.

DETAILED DESCRIPTION OF A PREFERRED EMBODIMENT

Figure 1:
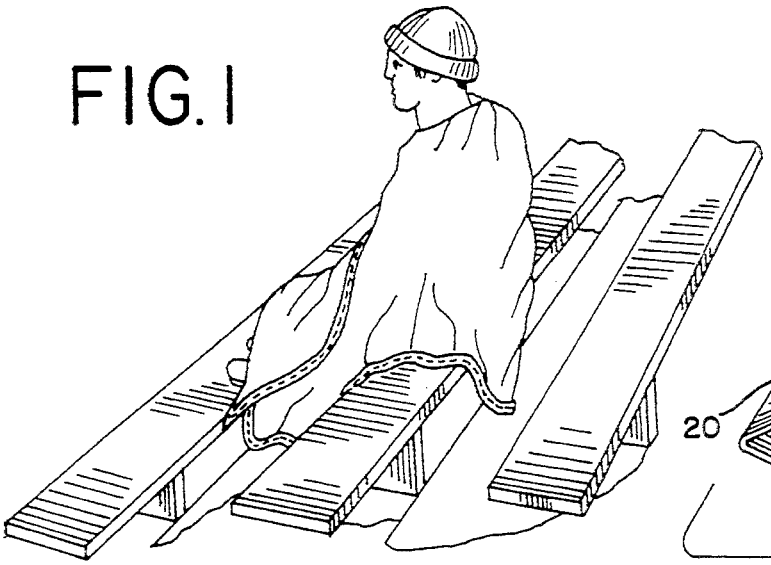
FIG. 1 is a pictorial illustration of a person displaying one of the many uses of a blanket of the present invention.

While this invention is susceptible of embodiment in many different forms, there is shown in the drawings and will herein be described in detail a preferred embodiment of the invention. The present disclosure is to be considered as an exemplification of the principles of the invention and is not intended to limit the broad aspect of the invention to the embodiment illustrated.

As shown in FIG. 1, a textile product in the form of a blanket, is draped around a person. Used in this manner, the blanket shields the person from the elements, such as rain, snow and cold, while in attendance at an outdoor function.

Figure 2:
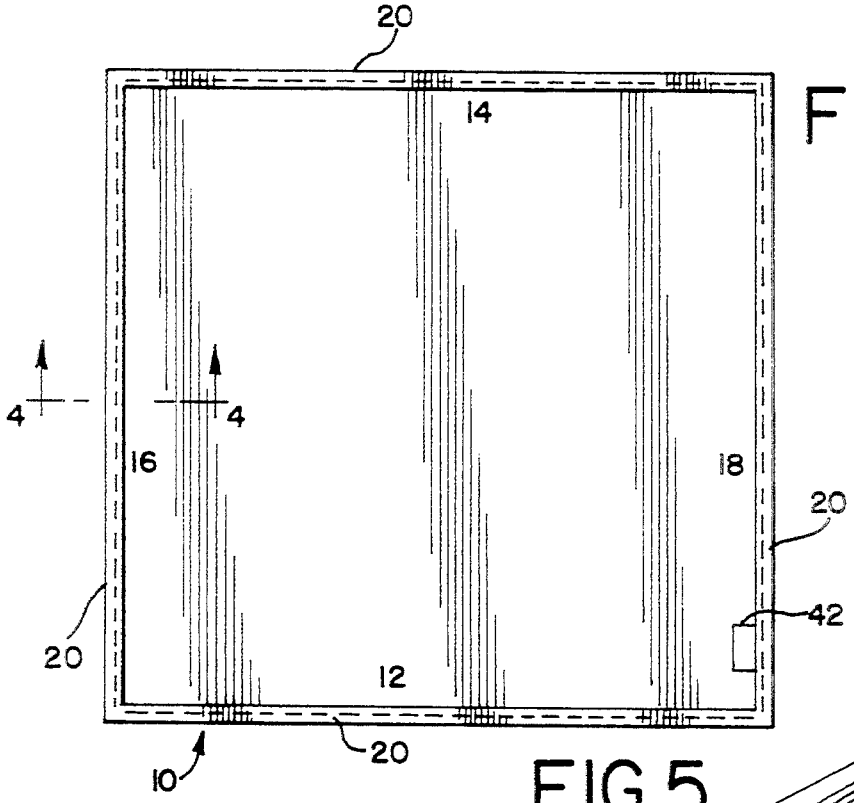
FIG. 2 is a top plan view of a blanket of the present invention.

A top plan view of the blanket of the present invention, generally designated by the reference number 10, is shown in FIG. 2. It has a generally rectangular shaped outer perimeter or border. The blanket 10 is substantially planar and has opposing substantially parallel ends 12 and 14, and opposing substantially parallel sides 16 and 18. Preferably, the opposing ends 12 and 14 are at least three to six feet, preferably four feet and ten inches, in length and the opposing sides 16 and 18 are at least three to six feet, preferably four feet and ten inches, in length. A binding element 20 is shown stitched along the outer perimeter or border of the blanket 10.

Figure 4:
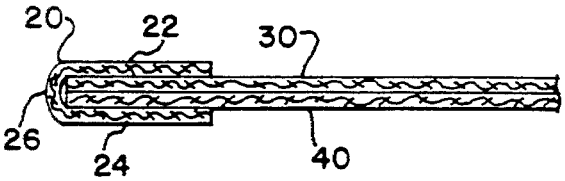
FIG. 4 is a cross-sectional view along the line 4—4 of the blanket shown in FIG. 2; and, FIG. 5 is a perspective view of the blanket of the present invention in a carrying case.

The blanket 10 generally has two layers. In particular, it has a first, substantially planar, water resistant or waterproof outer layer 30 having an outer surface and an inner surface and a second, separate, substantially planar, soft smooth lining inner layer 40 having an outer surface and an inner surface. Shown in cross-section in FIG. 4, the two layers 30 and 40 have substantially parallel opposing ends and substantially parallel opposing sides which correspond dimensionally with the ends 12 and 14 and sides 16 and 18, respectively, of the blanket 10. The layers 30 and 40 each have a generally rectangular shaped outer perimeter which correspond dimensionally and form part of the perimeter of the blanket 10.

The waterproof layer 30 is constructed of a nylon fabric. The nylon fabric is preferably constructed from a nylon thread having a denier of around 200. The individual fibers of the yarn in waterproof layer 30 can also be coated with a urethane coating; or, the outer surface of the waterproof layer 30 can be coated with a urethane. Preferably, $\frac{1}{2}$–$\frac{3}{4}$ ounces of urethane coating is required to provide a waterproof layer for a blanket 10 having the dimensions of four feet and ten inches by four feet and ten inches. The coating prevents water from penetrating the nylon fabric. The waterproof layer could also be made from a variety of other materials such as Tyvek ® or a plastic, as long as the material can generally be considered waterproof.

The soft smooth lining layer 40 is positioned adjacent and aligned with the waterproof layer 30 so that the inner surface of the soft lining layer 40 abuts the inner surface of the waterproof outer layer 30. This soft smooth lining layer 40 is preferably formed of 100% acrylic which has a soft velvety smooth feel to the touch. Alternatively, the lining may be a polyester and wool blend, a polyester and cotton flannel blend, a tricot (100% polyester) or a variety of other, soft materials. The lining may also be made of a cotton fabric. However, it is preferred that the lining layer 40 have a soft smooth feel because in a variety of applications, the lining layer 40 will be in contact with a user of the blanket. The lining may also be of a single color or utilize a variety of colors in a plaid or pattern.

Figure 3:
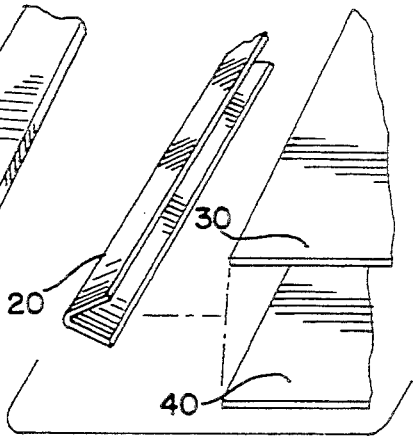
FIG. 3 is a fragmentary exploded view of a corner of the blanket shown in FIG. 2.

The binding element 20 is used to securably attach the lining layer 40 to the waterproof layer 30. The binding element 20 is preferably formed from a strip approximately twelve to twenty-four feet, preferably nineteen feet and four inches, long of heavy duty nylon with a denier around two hundred. As shown in FIG. 3, the binding element 20 is preferably folded over the perimeters of the waterproof layer 30 and lining layer 40 along the ends 12 and 14, and the sides 16 and 18. The binding element 20 has a first segment 22 positioned adjacent the outer surface of the waterproof layer 30 along its perimeter and spaced apart from the lining layer 40 by the waterproof layer 30. The binding element 20 has a second segment 24 positioned adjacent the outer surface of the lining layer 40 along its perimeter and spaced apart from the waterproof layer 30 by the lining layer 40. The binding element 20 has a generally arcuate bridging segment 26 connecting the first segment 22 and the second segment 24 so that the waterproof layer 30 and the lining layer 40 are sandwiched within the binding element 20 along their perimeters. The first segment 22 of the binding element 20, the waterproof layer 30, the lining layer 40 and the second segment of the binding element 20 are then all fastened together. Preferably, this fastening is accomplished by stitching the layers together with a heavy duty cotton and polyester thread. A printed nylon tear label 42 can be sewn into the binding. The label 42 may contain the manufacturer's name, the name or trademark of the product, instructions on maintenance and care of the blanket 10, or other information.

Additional layers, such as a spongy padding layer or another lining layer, may be sandwiched between the waterproof layer 30 and the lining layer 40. Similarly, more than one binding layer may be secured to the perimeter of the blanket 10 to provide additional weight to that area of the blanket 10. The advantages to this is to prevent the wind from blowing the blanket around while it is on the ground. It has been found that this additional weight can be added by using a very heavy material for the binding element 20.

Figure 5:
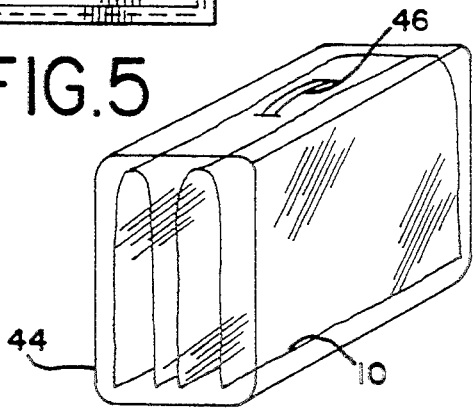

As shown in FIG. 5, the blanket 10 is preferably one component of a system which includes a case 44 as a second component. The blanket 10 can be stored and carried in a pocket in the case 44. The case is preferably made from a four gauge transparent or semi-transparent vinyl. The case 44 includes a handle 46 for easily transporting the blanket from location to location.

While a specific embodiment has been illustrated and described, numerous modifications come to mind without significantly departing from the spirit of the invention and the scope of protection is only limited by the scope of the accompanying claims.

I claim:

1. A system comprising:

a lightweight and foldable blanket having a first substantially planar generally waterproof nylon fabric layer having an inner surface, an outer surface, and a perimeter and being at least four feet in width and four feet in length, said outer surface of said nylon fabric layer being coated with urethane, and a second substantially planar generally soft smooth acrylic material lining layer having an inner surface, an outer surface and a perimeter and being at least four feet in width and four feet in length secured to the first waterproof layer by a separate binding element comprising a strip of material folded over and stitched to said perimeters of said first and second layers and abutting said outer surfaces of said first and second layers; and a transparent case having an inner pocket adapted to hold said blanket in a folded form.

2. The system of claim 1 wherein said case is made of a transparent vinyl.

3. The system of claim 1 wherein said binding element is a nylon strip.

4. The system of claim 1 wherein said nylon fabric layer has a denier of about 200.

5. The system of claim 1 wherein said binding element is a nylon strip having a denier of about 200.

6. The system of claim 1 wherein said binding element is a canvas strip.

7. The system of claim 1 wherein an additional binding element is secured to the perimeter of the blanket.

8. A system comprising:

a lightweight and foldable blanket having a first substantially planar generally waterproof nylon fabric layer having an inner surface, an outer surface, and a perimeter and being at least six feet in width and six feet in length, said outer surface of said nylon fabric layer being coated with urethane, and a second substantially planar generally soft smooth acrylic material lining layer having an inner surface, an outer surface and a perimeter and being at least six feet in width and six feet in length secured to the first waterproof layer by a separate binding element comprising a strip of material folded over and stitched to said perimeters of said first and second layers and abutting said outer surfaces of said first and second layers; and a transparent case having an inner pocket adapted to hold said blanket in a folded form.

9. The system of claim 8 wherein an additional binding element is secured to the perimeter of the blanket.

* * * * *